US006545950B1

(12) United States Patent
Walukas et al.

(10) Patent No.: US 6,545,950 B1
(45) Date of Patent: Apr. 8, 2003

(54) METHODS, SYSTEMS, WIRELESS TERMINALS, AND COMPUTER PROGRAM PRODUCTS FOR CALIBRATING AN ELECTRONIC CLOCK USING A BASE REFERENCE SIGNAL AND A NON-CONTINUOUS CALIBRATION REFERENCE SIGNAL HAVING GREATER ACCURACY THAN THE BASE REFERENCE SIGNAL

(75) Inventors: Joel James Walukas, Cary, NC (US); Anthony Joseph Ricotta, Jr., Wake Forest, NC (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/571,461

(22) Filed: May 16, 2000

(51) Int. Cl.[7] ..... G04B 45/00
(52) U.S. Cl. ..... 368/47; 364/200
(58) Field of Search ..... 367/47, 10, 200–202, 367/48–60

(56) References Cited

U.S. PATENT DOCUMENTS

| | | | | | |
|---|---|---|---|---|---|
| 4,074,514 | A | | 2/1978 | Vaucher | 58/23 |
| 4,763,309 | A | * | 8/1988 | Descombes | 368/201 |
| 5,327,404 | A | * | 7/1994 | Nolan | 368/201 |
| 5,481,507 | A | * | 1/1996 | Suzuki et al. | 368/201 |
| 5,530,407 | A | * | 6/1996 | Yabe et al. | 368/201 |
| 5,587,691 | A | * | 12/1996 | Yabe et al. | 368/201 |
| 5,644,271 | A | * | 7/1997 | Mollov et al. | 368/202 |
| 5,717,661 | A | * | 2/1998 | Poulson | 368/202 |
| 5,740,129 | A | * | 4/1998 | Frampton | 368/201 |

FOREIGN PATENT DOCUMENTS

| | | |
|---|---|---|
| EP | 0052884 A1 | 6/1982 |
| EP | 0253227 A1 | 1/1988 |
| EP | 0586256 A2 | 3/1994 |
| EP | 0768583 A2 | 4/2002 |

OTHER PUBLICATIONS

Benzler, S, "Regulierung und Komensation Åusserer Einflusse Mit Digitalenabgleichverfahren Bei Quarzuhren," *Jahrbuch Der Deutschen Gesellschaft Für Chronometrie E.V.* XP002185305, vol. 28, 1977, pp. 16–25.

(List continued on next page.)

*Primary Examiner*—David Martin
*Assistant Examiner*—Michael L. Lindinger
(74) *Attorney, Agent, or Firm*—Myers Bigel Sibley & Sajovec, P.A.

(57) ABSTRACT

Electronic clock calibration systems, methods, and computer program products use a calibration reference signal to calibrate an electronic clock that generates an output signal and that is responsive to a base reference signal. The base reference signal is less accurate than the calibration reference signal and, therefore, has an actual frequency and an ideal frequency associated therewith. The difference between the actual frequency and the ideal frequency represents the inaccuracy of the base reference signal. The calibration reference signal may be used to determine this difference between the actual frequency and ideal frequency of the base reference signal. Once this difference is determined, the frequency of the electronic clock output signal may be adjusted to compensate for the inaccuracy of the base reference signal. The base reference signal is often generated by a crystal oscillator circuit in consumer electronic devices, which is susceptible to frequency drift based on age, temperature, shock, and other environmental factors. Crystal oscillator circuits have an advantage in that they use relatively little power and, thus, tend to preserve battery life. The accuracy of a crystal oscillator circuit may be improved through use of a more accurate calibration reference signal that need not be available continuously.

21 Claims, 5 Drawing Sheets

OTHER PUBLICATIONS

International Search Report for PCT/US01/11616, dated Apr. 10, 2002.

Texas Instruments, *MSP430 Architecture and Module Library User's Guide*, Chapter 11, *Timer_A*, pp. 11–1–11–40, 1996.

Ricoh Company Ltd., Electronic Devices Division, *I²CBus Serial Interface Real Time Clock, RS5C372A Application Manual*, Jun. 1995.

Intel Corporation, *8XC51RA/RB/RC Hardware Description*, Feb. 1995.

* cited by examiner

METHODS, SYSTEMS, WIRELESS TERMINALS, AND COMPUTER PROGRAM PRODUCTS FOR CALIBRATING AN ELECTRONIC CLOCK USING A BASE REFERENCE SIGNAL AND A NON-CONTINUOUS CALIBRATION REFERENCE SIGNAL HAVING GREATER ACCURACY THAN THE BASE REFERENCE SIGNAL

BACKGROUND OF THE INVENTION

The present invention relates generally to the field of electronic time-keeping, and, more particularly, to calibration of electronic clocks to correct for inaccuracies or drift.

Battery powered consumer electronics devices often use crystal oscillators. The accuracy of a conventional crystal oscillator may be characterized according to error contribution from environmental factors and/or inherent limitations of the crystal. For example, the accuracy of a Micro Crystal MC-306 32 kHz crystal may be characterized as follows:

| Error Contribution | Maximum Value | Units |
|---|---|---|
| Frequency Tolerance | ±20–50 | ppm (parts per million) |
| Temperature Coefficient | −0.04 | ppm/$C^2$ |
| Drift due to Aging | ±3 | ppm/year |
| Drift from Mechanical Shock | ±5 | ppm |

Small deviations on the order of 1–5 ppm may also be introduced due to variations in the voltage applied to the crystal. Accordingly, inasmuch as 1 ppm equates to approximately 30 seconds per year, a crystal oscillator may be relatively accurate as a short-term time reference, but may exhibit a noticeable accumulated error if used for long-term time-keeping.

Several design approaches may be used to correct for deviations in crystal frequency. One relatively straightforward design approach to improving the accuracy of a crystal oscillator is to use higher quality components in the oscillator circuit (e.g., the crystal, trim capacitors, and voltage source). While this design approach may have the benefit of simplicity, it generally results in only incremental error improvements. More sophisticated circuit topologies may provide greater accuracy, but may also add complexity and cost to the time-keeping system.

A second design approach may be used in which the crystal oscillator provides a base reference signal. This base reference signal is used as an input signal for a digital counter. Overflow of the digital counter may be used as a clock signal that is used for time-keeping. The period between overflows, which corresponds to the period of the clock signal, may be controlled through an automatic reload (auto-reload) register that provides a starting value for the digital counter after the counter overflows. The auto-reload register is generally accessible by the system software and/or a hardware state machine. For example, if the digital counter is an up-counter, increasing the value in the auto-reload register decreases the clock signal period. Conversely, decreasing the value in the auto-reload register increases the clock signal period. The $I^2C$ Bus Serial Interface Real Time Clock (RS5C372A) Application Manual by Ricoh Corporation provides an exemplary implementation of the foregoing design approach in which a "time trimming register" is used to adjust the overflow period of a digital counter that is driven by a 32 kHz crystal oscillator.

Thus, by writing an appropriate value into an auto-reload register or time trimming register, inaccuracies in a crystal oscillator may be compensated for. Unfortunately, the value to be written into the auto-reload register or time trimming register is generally left to the user to determine. Consequently, there exists a need for improved time-keeping systems and related calibration methods.

SUMMARY OF THE INVENTION

Electronic clock calibration systems, methods, and computer program products may use a calibration reference signal to calibrate an electronic clock that generates an output signal and that is responsive to a base reference signal. The base reference signal is less accurate than the calibration reference signal and, therefore, has an actual frequency and an ideal frequency associated therewith. The difference between the actual frequency and the ideal frequency represents the inaccuracy of the base reference signal. The calibration reference signal may be used to determine this difference between the actual frequency and ideal frequency of the base reference signal. Once this difference is determined, the frequency of the electronic clock output signal may be adjusted to compensate for the inaccuracy of the base reference signal.

The base reference signal is often generated by a crystal oscillator circuit in consumer electronic devices, which is susceptible to frequency drift based on age, temperature, shock, and other environmental factors. Crystal oscillator circuits have an advantage in that they use relatively little power and, thus, tend to preserve battery life. Advantageously, the accuracy of a crystal oscillator circuit may be improved through use of a more accurate calibration reference signal that need not be available continuously.

The present invention may be embodied in a wireless terminal. In particular, a high accuracy base station clock signal may be used to calibrate an electronic clock in the wireless terminal. A crystal oscillator circuit in the wireless terminal may be used to provide the base reference signal, which drives the electronic clock.

In accordance with an aspect of the invention, the difference between the actual frequency of the base reference signal and the ideal frequency of the base reference signal may be determined by defining an ideal calibration interval, which is based on the ideal frequency of the base reference signal. An ideal number of cycles of the calibration reference signal may then be determined based on the frequency of the calibration reference signal and the length of the ideal calibration interval. An actual number of cycles of the calibration reference signal may also be determined using an actual calibration interval, which is based on the actual frequency of the base reference signal. The difference between the actual number of cycles of the calibration reference signal and the ideal number of cycles of the calibration reference signal may then be used to adjust the frequency of the electronic clock output signal.

In accordance with another aspect of the invention, the actual number of cycles of the calibration reference signal in the actual calibration interval may be determined by providing a counter that is responsive to the calibration reference signal and then reading the (counter value at the beginning and end of the actual calibration interval. The difference between the two counts corresponds to the actual number of cycles of the calibration reference signal in the actual calibration interval.

In accordance with still another aspect of the present invention, the difference between the actual number of cycles of the calibration reference signal and the ideal number of cycles of the calibration reference signal may be multiplied by a scaling factor to generate a calibration value, which is stored in a trim register that is associated with the electronic clock. The electronic clock may comprise a counter that is loaded with the calibration value in the trim register once per period of the electronic clock output signal (e.g., when the counter rolls over) to compensate for the inaccuracy of the base reference signal.

In accordance with yet another aspect of the invention, the ambient temperature may be recorded contemporaneously with the frequency adjustment of the electronic clock output signal. This allows the ambient temperature to be measured later to determine if a change in temperature has occurred since the electronic clock has been calibrated. If a temperature change has occurred, then the frequency of the electronic clock output signal may be adjusted based on the difference between the currently measured ambient temperature and the previously recorded ambient temperature.

Advantageously, electronic clock calibration systems, methods, and computer program products in accordance with the present invention may be implemented using conventional hardware and/or software components that may be provided in commercially available microcontroller systems. Moreover, the electronic calibration principles discussed herein may be used in any electronic device that includes an electronic clock that is derived from a relatively inaccurate base reference signal, but that has access to a more accurate calibration reference signal for one or more time intervals during which the electronic clock may be calibrated. Examples of such devices include cellular phones, hand-held calculators or personal digital assistants (PDAs), laptop computers, and electronic games.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION OF PREFERRED EMBODIMENTS

Figure 1:
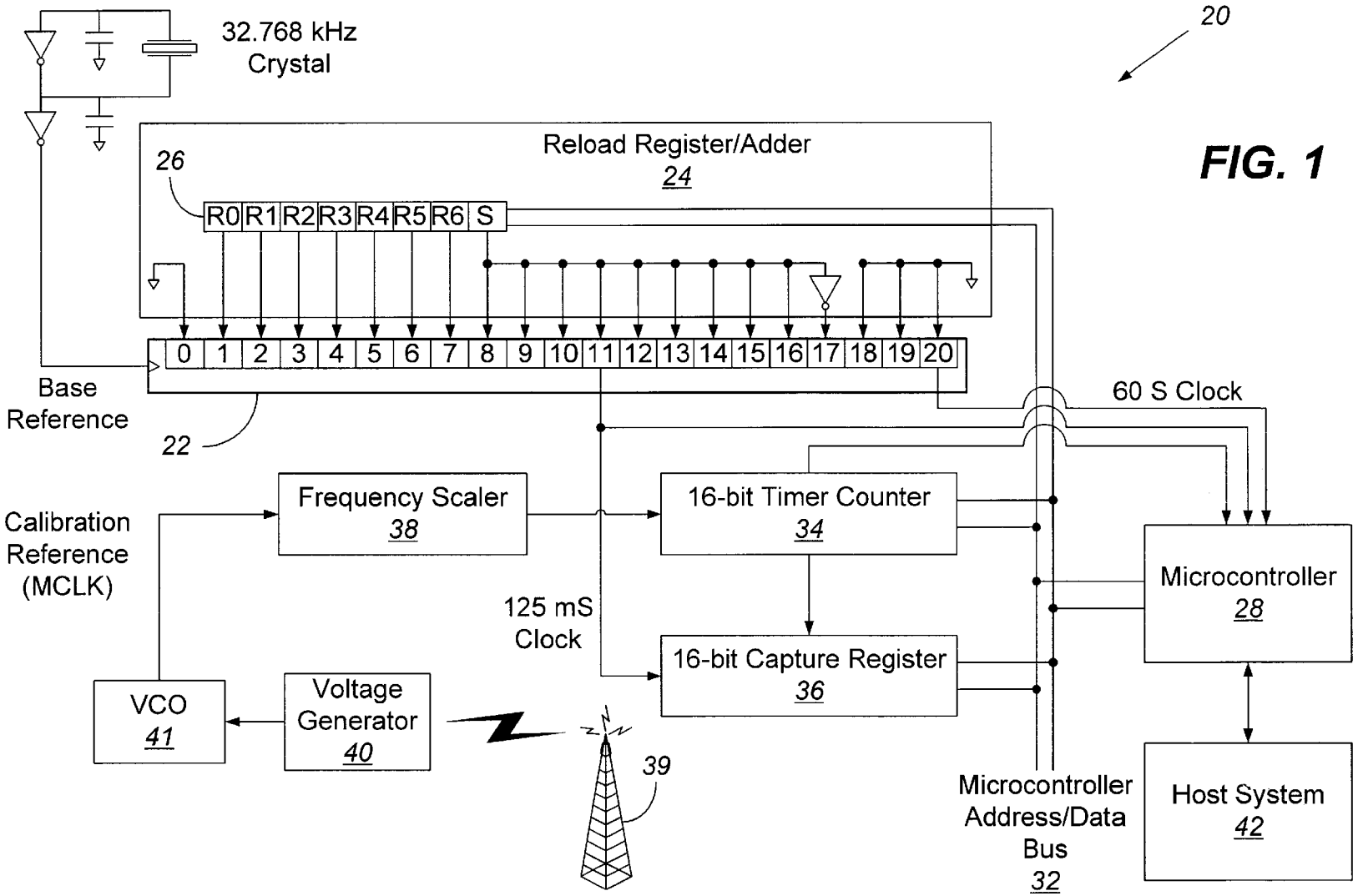
FIG. 1 is a block diagram that illustrates methods, systems, wireless terminals, and computer program products in accordance with embodiments of the present invention.

While the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention as defined by the claims. Like reference numbers signify like elements throughout the description of the figures.

The present invention may be embodied as a method, system, wireless terminal, and/or computer program product. Accordingly, the present invention may take the form of an entirely hardware embodiment, an entirely software (including firmware, resident software, micro-code, etc.) embodiment, or an embodiment containing both software and hardware aspects. Furthermore, the present invention may take the form of a computer program product on a computer-usable or computer-readable storage medium having computer-usable or computer-readable program code embodied in the medium for use by or in connection with an instruction execution system. In he context of this document, a computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

For purposes of illustration and in no way limited thereto, methods, systems, wireless terminals, and computer program products are described hereinafter in connection with a cellular phone system. It should nevertheless be understood that the principles of the present invention are applicable to any electronic device that includes an electronic clock or time-keeping system that is derived from a relatively inaccurate base reference signal, but that has access to a more accurate calibration reference signal for one or more time intervals during which the electronic clock or time-keeping system may be calibrated. With reference to FIG. 1, a time-keeping system 20 in accordance with the present invention includes a binary up-counter 22 with auto-reload on overflow that is driven by a base reference signal generated by a 32.768 kHz crystal oscillator. The binary up-counter 22 comprises a twenty-one bit counter with bit twenty serving as a 60 second electronic clock signal. The binary up-counter 22 may be loaded with an initial value through a reload register/adder 24 both at startup and when the binary up-counter 22 rolls over. The reload register/adder 24 may be implemented via software, hardware, or a combination thereof. In accordance with a preferred embodiment of the present invention, the reload register/adder 24 includes a trim register 26 for setting the values of bits one through eight, which is added to a nominal 2000 (hex) auto-reload value by twos-complement addition. Thus, the binary up-counter 22 may be viewed as an electronic clock that is responsive to a base reference signal provided by the 32.768 kHz crystal oscillator. The reload register/adder 24 may be used to calibrate the 60 second electronic clock signal generated by the binary up-counter 22 or electronic clock as will be described in detail hereinafter.

The time-keeping system 20 further includes a microcontroller 28 that may access the trim register 26 via an address/data bus 32. The microcontroller 28 has access to a general purpose 16-bit timer counter 34 with auto-reload on overflow and a 16-bit capture register 36 via the address/data bus 32. The 16-bit capture register 36 may be configured to "capture" the value contained in the 16-bit timer counter 34 upon a low-to-high transition of a 125 mS clock corresponding to bit eleven of the binary up-counter 22. The microcontroller 28 may be implemented by using a commercially available microcontroller that has a built-in 16-bit general purpose timer and capture register. The Intel 8XC51FA/FB/FC microcontroller, which includes a general purpose 16-bit timer having a capture mode and the Texas Instruments MSP430 microcontroller, which includes a general purpose 16-bit timer and an associated capture/compare register are exemplary microcontroller systems that may be used to implement the microcontroller 28, the 16-bit timer counter 34, and the 16-bit capture register 36.

The 16-bit timer counter 34 is responsive to a calibration reference signal (MCLK) that may be processed by a frequency scaler 38. In a cellular phone, the calibration reference signal may be provided by the main cellular system reference signal. A cellular base station 39 may transmit a signal that may be processed by a voltage generator 40 to generate a voltage. This voltage may be used to control a voltage controlled oscillator (VCO) 41, which may generate the main cellular system reference signal. The main cellular system reference signal may exhibit sub 1 ppm accuracy via feedback control with the cellular base station while the phone is transmitting. Although the calibration reference signal is more accurate than the 32.768 kHz crystal, it is not continuously available because the cellular phone is powered down most of the time to preserve battery life. Because of its low power consumption, the crystal oscillator is preferred for generating the base reference signal notwithstanding its lower accuracy. In Ericsson time division multiple access (TDMA) or Telecommunication Industry Association (TIA)/Electronic Industries Association (EIA) 136 phones, the main cellular system reference signal is 19.44 MHz. Similarly, in Ericsson code division multiple access (CDMA) or TIA interim standard (IS) 95 phones, the main cellular system reference signal is 19.2 MHz. In a preferred embodiment of the present invention, the frequency scaler 38 divides the frequency of the calibration reference signal by four. The level of scaling applied is based on the frequency of the calibration reference signal, the size (i.e., the number of bits) of the timer counter 34, and the period of the clock used to drive the 16-bit capture register 36. It should be understood that these parameters (i.e., frequency of the calibration reference signal, size of the timer counter 34, and period of the clock used to drive the 16-bit capture register 36) may be changed based on the accuracy level desired for the 60 second clock signal generated by the binary up-counter 22.

The microcontroller 28 is responsive to the 60 second clock signal generated by the binary up-counter 22 and a timer capture interrupt signal from the 16-bit timer counter 34 that indicates a timer value is available in the 16-bit capture register 36. The microcontroller 28 provides the 60 second clock signal to the hardware/software (not shown) responsible for maintaining the human-machine clock interface. Upon receiving a first timer capture interrupt signal, the microcontroller 28 processes the data contained in the 16-bit capture register 36. After receiving a second timer capture interrupt signal, the microcontroller 28 processes the data contained in the 16-bit capture register 36 and generates an interrupt for a host system 42. The host system 42 generates a calibration value for the trim register 26 using data provided by the microcontroller 28. Although the microcontroller 28 and host system 42 are shown as separate units in FIG. 1, these two units may be implemented using a single processor and memory structure. Operations involved in processing the data from the 16-bit capture register 36 and in generating the calibration value will be described in detail hereinafter.

Figure 2:
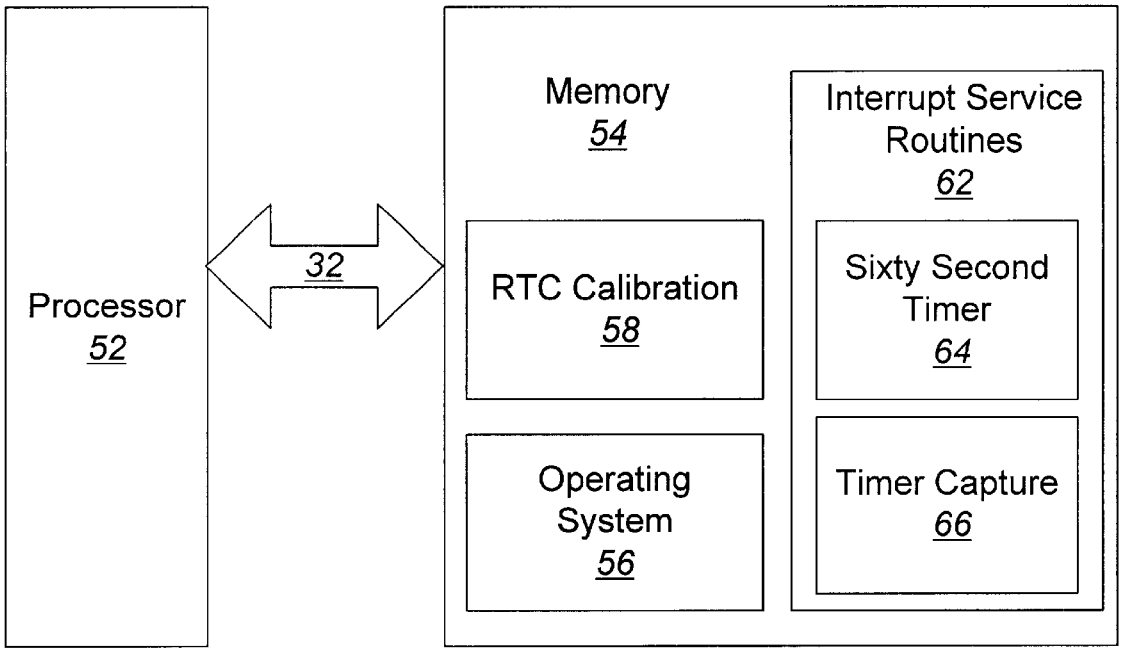
FIG. 2 is a block diagram that illustrates an embodiment of a microcontroller shown in FIG. 1 in greater detail.

FIG. 2 illustrates the microcontroller 28 in more detail. The microcontroller 28 includes a processor 52 that communicates with a memory 54 via the address/data bus 32. The processor 52 may be any commercially available or custom microprocessor suitable for an embedded application. The memory 54 is representative of the overall hierarchy of memory devices containing the software and data used to implement the functionality of the time-keeping system 20. The memory 54 may include, but is not limited to, the following types of devices: cache, ROM, PROM, EPROM, EEPROM, flash, SRAM, and DRAM.

As shown in FIG. 2, the memory 54 may hold an operating system module 56, a real time clock (RTC) calibration module 58, and an interrupt service routines module 62. The operating system 56 should be designed for real time embedded applications and, preferably, is relatively compact to make efficient use of the memory 54. The RTC calibration module 58 comprises program code for managing the hardware components of the time-keeping system 20, such as the reload register/adder 24, the trim register 26, the 16-bit timer counter 34, and the 16-bit capture register 36.

The interrupt service routines module 62 comprises programs for responding to hardware and/or software interrupts received by the microcontroller 28. In particular, the interrupt service routines module 62 includes a sixty second clock program module 64 and a timer capture program module 66. The sixty second clock program module 64 processes the interrupt generated by the 60 second clock signal, which is output from the binary up-counter 22. The timer capture program module 66 processes the interrupt generated by the timer capture signal, which corresponds to low-to-high transitions of the 125 mS clock and indicates that the value of the 16-bit timer 34 has been captured and is available in the 16-bit capture register 36.

Figure 3:
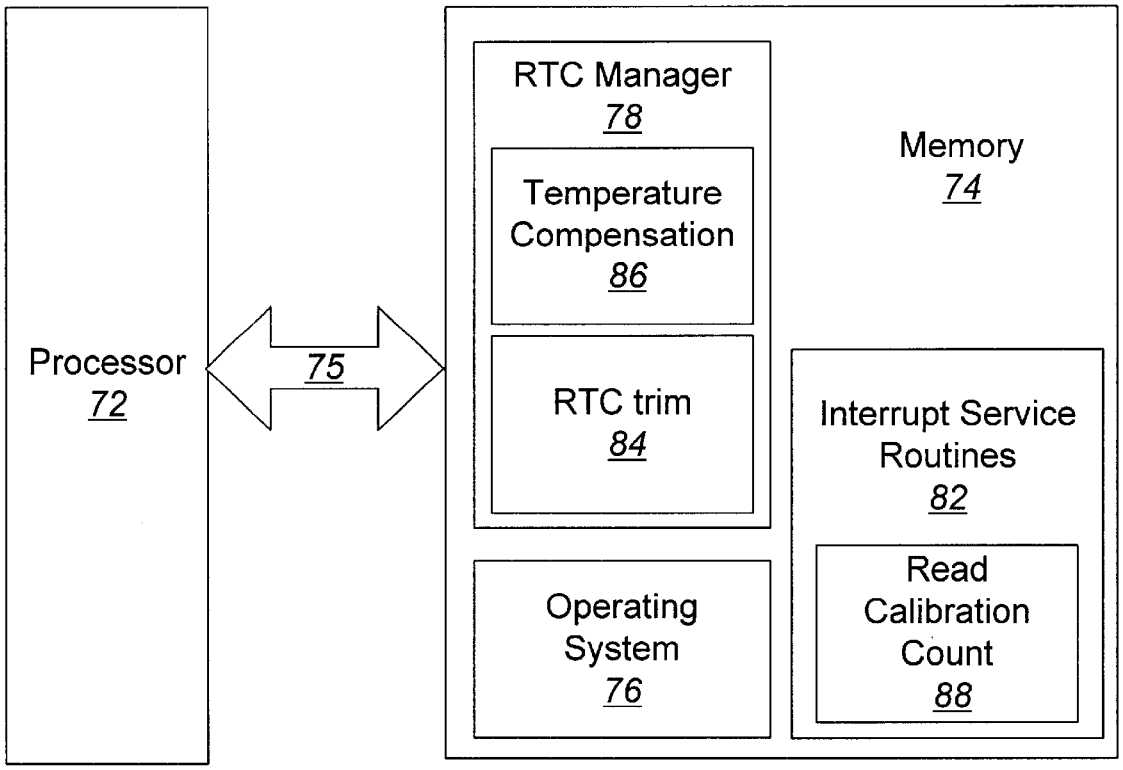
FIG. 3 is a block diagram that illustrates an embodiment of a host system shown in FIG. 1 in greater detail.

FIG. 3 illustrates the host system 42 in more detail. The host system 42 includes a processor 72 that communicates with a memory 74 via an address/data bus 75. The processor 72 may be any commercially available or custom microprocessor suitable for an embedded application. The memory 74 is representative of the overall hierarchy of memory devices containing the software and data used to determine a calibration value for the trim register 26 to improve the accuracy of the binary up-counter 22. The memory 74 may include, but is not limited to, the following types of devices: cache, ROM, PROM, EPROM, EEPROM, flash, SRAM, and DRAM.

As shown in FIG. 3, the memory 74 may hold an operating system module 76, an RTC manager module 78, and an interrupt service routines module 82. The operating system 76 should be designed for real time embedded applications and, preferably, is relatively compact to make efficient use of the memory 74. The RTC manager module 78 comprises programs for determining a calibration value for the trim register 26. In particular, the RTC manager module 78 includes an RTC trim program module 84 and, optionally, a temperature compensation program module 86.

The RTC trim program module 84 determines the appropriate calibration value for the trim register 26 based on the frequency deviation exhibited by the crystal oscillator from an ideal frequency of 32.768 kHz. The temperature compensation program module 86 may be used to record the ambient temperature when a new calibration value is generated by the RTC trim program module 84 and then to periodically measure the ambient temperature through a temperature sensor (not shown). The calibration value in the trim register 26 may then be adjusted based on the difference between the current temperature and the temperature associated with a previous calibration value.

The interrupt service routines module 82 comprises programs for responding to hardware end/or software interrupts received by the host system 42. In particular, the interrupt service routines module 62 includes a read calibration count program module 88 that processes an interrupt generated by the microcontroller 28 when the data used by the RTC trim program module 84 to determine the calibration value for the trim register 26 is available.

Computer program code for carrying out operations of the interrupt service routines program modules 62 and 82 is typically written in assembly or machine language or in micro-code to enhance speed. The RTC calibration program module 58 on the microcontroller 28 and the RTC manager program module 78 on the host system 42 may be written in a high level programming language such as C or C++. It should be understood that while the program code for carrying out operations of the time-keeping system 20 is divided between the microcontroller 28 and the host system 42 in a preferred embodiment of the present invention, the program code may also be designed to execute entirely on the microcontroller 28 or entirely on the host system 42.

Before discussing exemplary operations of the time-keeping system 20, it may be helpful to define the following parameters, which are used in determining a calibration value for the trim register 26:

| | |
|---|---|
| $T_{MCLK/4}$ | The period of the calibration reference signal (MCLK) after the frequency scaler 38 has divided the signal by four. |
| $T_{REF}$ | The ideal calibration interval period of .125 seconds (4096 cycles of the ideal 32.768 kHz base reference signal). |
| N | The number of MCLK/4 cycles in the ideal calibration interval period ($T_{REF}$) ($N * T_{MCLK/4} = T_{REF} = .125$ seconds). |
| T125M | The actual calibration interval period corresponding to the period between consecutive low-to-high transitions of the 125 mS clock, which is generated by bit eleven of the binary up-counter 22 ($T125M = 4096 * T_{32kHz}$). |
| COUNT | The number of MCLK/4 cycles in the actual calibration interval period (T125M) ($COUNT * T_{MCLK/4} = T125M$). |
| T60 | The period between consecutive low-to-high transitions of the 60 second clock, which is generated by bit twenty of the binary up-counter 22. |
| $T_{32kHz}$ | The actual period of the 32.768 kHz crystal oscillator. |

Figure 4:
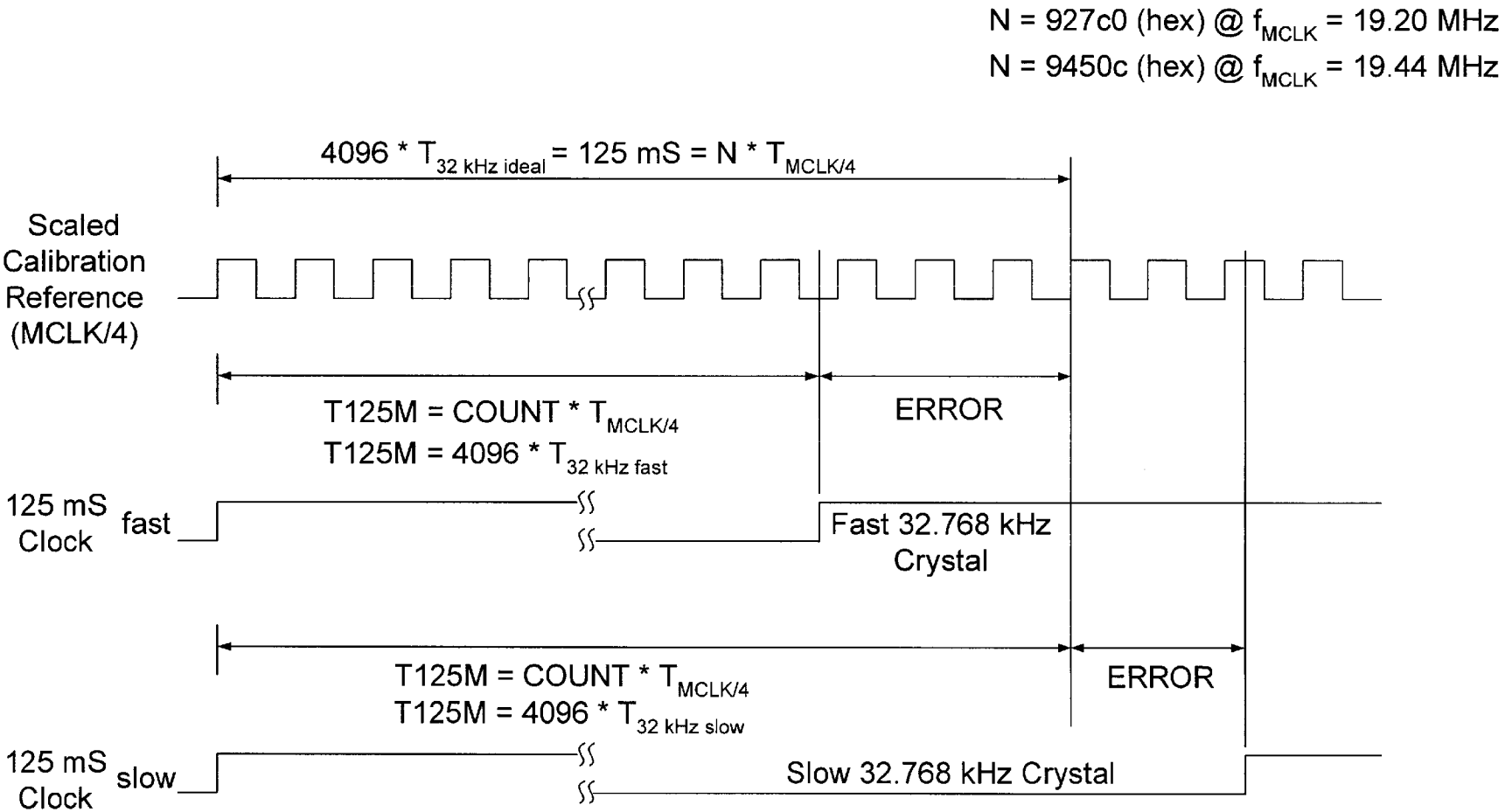
FIG. 4 is a waveform diagram that illustrates signals generated in embodiments of electronic clock calibration systems of FIG. 1.

Referring now to FIG. 4, the ideal calibration interval $T_{REF}$ has a period of 125 mS, which is based on the frequency of the 125 mS clock generated by bit eleven of the binary up-counter 22 (each bit of the binary up-counter 22 divides the crystal oscillator frequency in half; therefore, bit eleven has a frequency given by $32768\ Hz/2^{12}=8\ Hz$). If, however, the frequency of the base reference signal generated by the crystal oscillator deviates from its ideal value of 32.768 kHz, then the actual calibration interval period T125M will also deviate from the ideal calibration interval $T_{REF}$.

This is illustrated in FIG. 4 where, for example, if the crystal oscillator is running fast, then $T125M<T_{REF}$ (125 mS) and the number of scaled calibration reference signal (MCLK/4) cycles in the actual calibration interval period T125M is less than the number of scaled calibration reference signal (MCLK/4) cycles in the ideal calibration interval $T_{REF}$ (125 mS). That is, COUNT<N. In this case, the 60 second clock requires N−COUNT additional cycles of the base reference signal (i.e., crystal oscillator signal) to extend its period (T60) to 60 seconds. Accordingly, the calibration value for the trim register 26 is negative so that cycles are added to the rollover count of the binary up-counter 22.

On the other hand, if the crystal oscillator is running slow, then $T125M>T_{REF}$ (125 mS) and the number of scaled calibration reference signal (MCLK/4) cycles in the actual calibration interval period T125M is greater than the number of scaled calibration reference signal (MCLK/4) cycles in the ideal calibration interval $T_{REF}$ (125 mS). That is, COUNT>N. In this case, the 60 second clock requires COUNT−N fewer cycles of the base reference signal (i.e., crystal oscillator signal) to reduce its period (T60) to 60 seconds. Accordingly, the calibration value for the trim register 26 is positive so that cycles are subtracted from the rollover count of the binary up-counter 22.

The present invention is described hereinafter with reference to flowchart and/or block diagram illustrations of communication devices, methods, and computer program products in accordance with exemplary embodiments of the invention. It will be understood that each block of the flowchart and/or block diagram illustrations, and combinations of blocks in the flowchart and/or block diagram illustrations, may be implemented by computer program instructions. These computer program instructions may be provided to a processor of a general purpose computer, a special purpose computer, or other programmable data processing apparatus to produce a machine, such that the instructions, which execute via the processor of the computer or other programmable data processing apparatus, create means for implementing the functions specified in the flowchart and/or block diagram block or blocks.

These computer program instructions may also be stored in a computer usable or computer-readable memory that may direct a computer or other programmable data processing apparatus to function in a particular manner, such that the instructions stored in the computer usable or computer-readable memory produce an article of manufacture including instruction means that implement the function specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the flowchart and/or block diagram block or blocks.

Figure 5A:
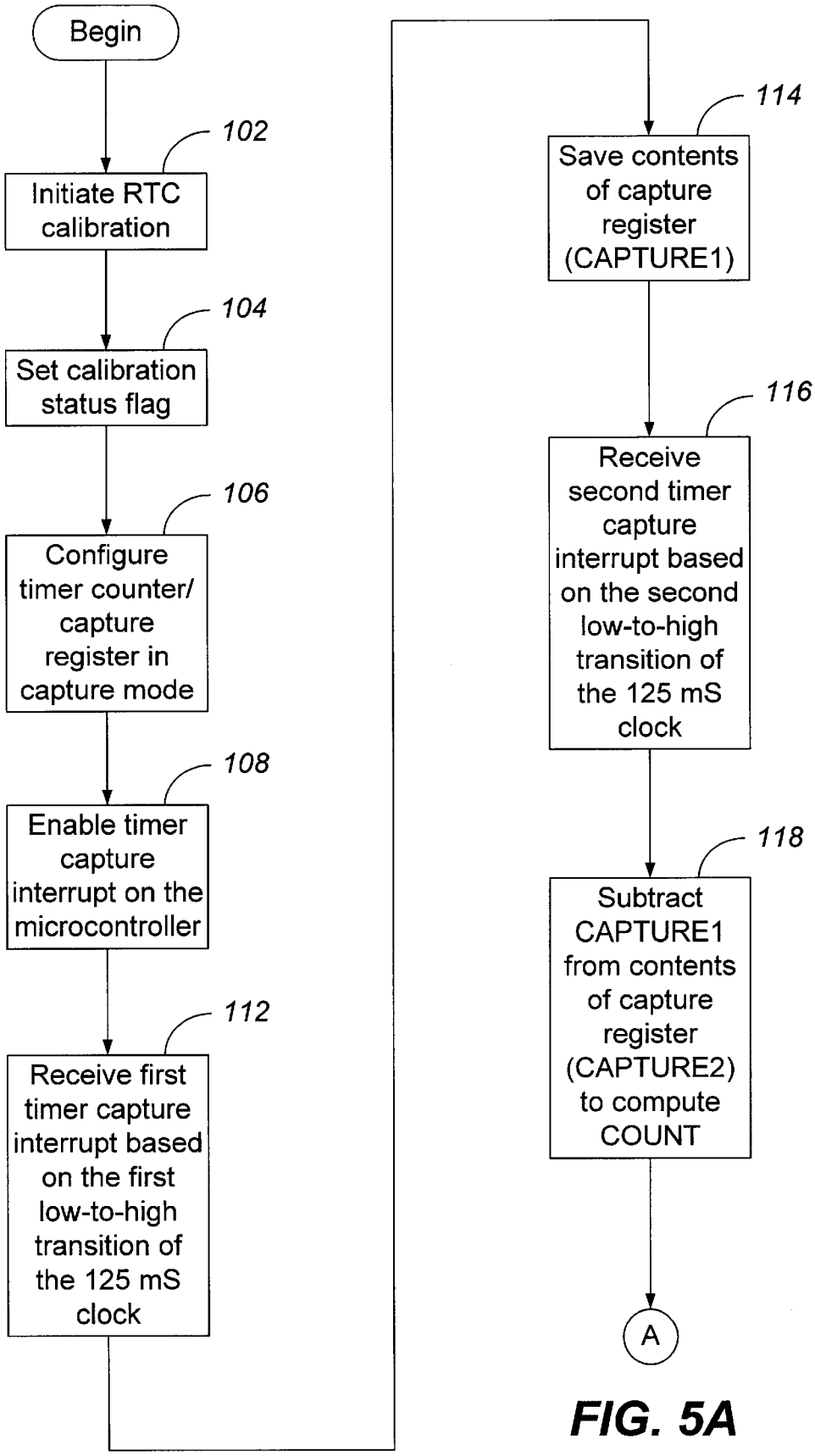
FIGS. 5A–5B are a flowchart that illustrates exemplary operations of methods, systems, wireless terminals, and computer program products of FIG. 1 in accordance with embodiments the present invention.

With reference to the flowchart of FIG. 5A, exemplary operations of the time-keeping system 20 begin at block 102 where the RTC manager program module 78 running on the host system 42 initiates a calibration procedure for the binary up-counter 22. In a preferred embodiment of the present invention, a "START_RTC_CALIBRATION" message is defined and is passed from the host system 42 to the microcontroller 28 via a serial interface to initiate the calibration procedure. Upon receiving the START_RTC_CALIBRATION message, the RTC calibration program module 58 running on the microcontroller 28 sets a calibration status flag at block 104 to indicate to the host system 42 that calibration of the binary up-counter 22 is in progress and the calibration value in the trim register 26 is no longer valid. The RTC calibration program module 58 also configures the 16-bit timer counter 34 and 16-bit capture register 36 in capture mode using the 125 mS clock as a trigger at block 106. Finally, at block 108, the RTC calibration program module 58 enables the timer capture interrupt on the microcontroller 28.

Next, a first timer capture interrupt is received by the microcontroller 28 at block 112 on the first low-to-high transition of the 125 mS clock. The timer capture interrupt service routine 66 processes this interrupt by saving the contents of the 16-bit capture register 36 in a storage location (e.g., in a register or in the memory 54) as CAPTURE1 at block 114. Recall that the 16-bit capture register 36 "captures" the value of the 16-bit timer counter 34 when the 125 mS clock transitions from low-to-high. After the actual calibration interval period T125M has elapsed, a second timer capture interrupt will be received at block 116. The timer capture interrupt service routine 66 processes this interrupt by subtracting CAPTURE1, which was saved at block 114, from the contents of the 16-bit capture register 36 (CAPTURE2) to compute the parameter COUNT (i.e., the number of scaled calibration reference signal (MCLK/4) cycles in an actual calibration interval period (T125M)) at block 118.

Note that in a preferred embodiment of the present invention, the 16-bit timer counter 34 may represent the 16 least significant bits (LSBs) of an arbitrarily large count sequence. Therefore, the results of the first timer interrupt (CAPTURE1) represent the 16 LSBs of a smaller count value COUNT1. Similarly, the results of the second timer interrupt (CAPTURE2) represent the 16 LSBs of a larger count value COUNT2. Inasmuch as COUNT2 and COUNT1 are assumed to be read from an arbitrarily large free running counter, COUNT2 is greater than COUNT1. Therefore, CAPTURE1 may be subtracted from CAPTURE2 with borrow, which, in effect, forces sign extension and allows CAPTURE1 and CAPTURE2 to be treated as unsigned values.

As discussed in the foregoing, COUNT1 and COUNT2 are assumed to be based on an arbitrarily large count sequence yet only the 16 LSBs of these two values are used to compute their difference (COUNT). The following example illustrates why the higher order bits may not be needed in computing the parameter COUNT and in computing a difference between COUNT and N according to the present invention. If the calibration reference signal frequency is either 19.44 MHz or 19.2 MHz, as is used in TDMA wireless terminals and CDMA wireless terminals, respectively, and the time-keeping system 20 is stable, then the difference between the high order bits (e.g., bits 16 through 31 of a 32 bit word) of COUNT2 and COUNT1 is a constant value, which is 90000 (hex) in a preferred embodiment of the present invention. The number of MCLK/4 cycles in the ideal calibration interval period, N, is also represented by the same constant value of 90000 (hex) in its high order bits for calibration reference signal frequencies of either 19.44 MHz or 19.2 MHz. Therefore, because what is ultimately of interest is the difference between COUNT and N, the high order bits may be ignored because they have the same constant value and their difference will be zero. Thus, in a preferred embodiment of the present invention that is based on a calibration reference signal (MCLK) frequency of either 19.44 MHz or 19.2 MHz, the timer counter 34 may be implemented using 16 bits because the high order bit difference between COUNT2 and COUNT1 is constant when the system is stable. In general, the number of bits used to implement the timer counter 34 is preferably chosen by determining a number of bits above which the difference between COUNT2 and COUNT1 is constant.

Figure 5B:
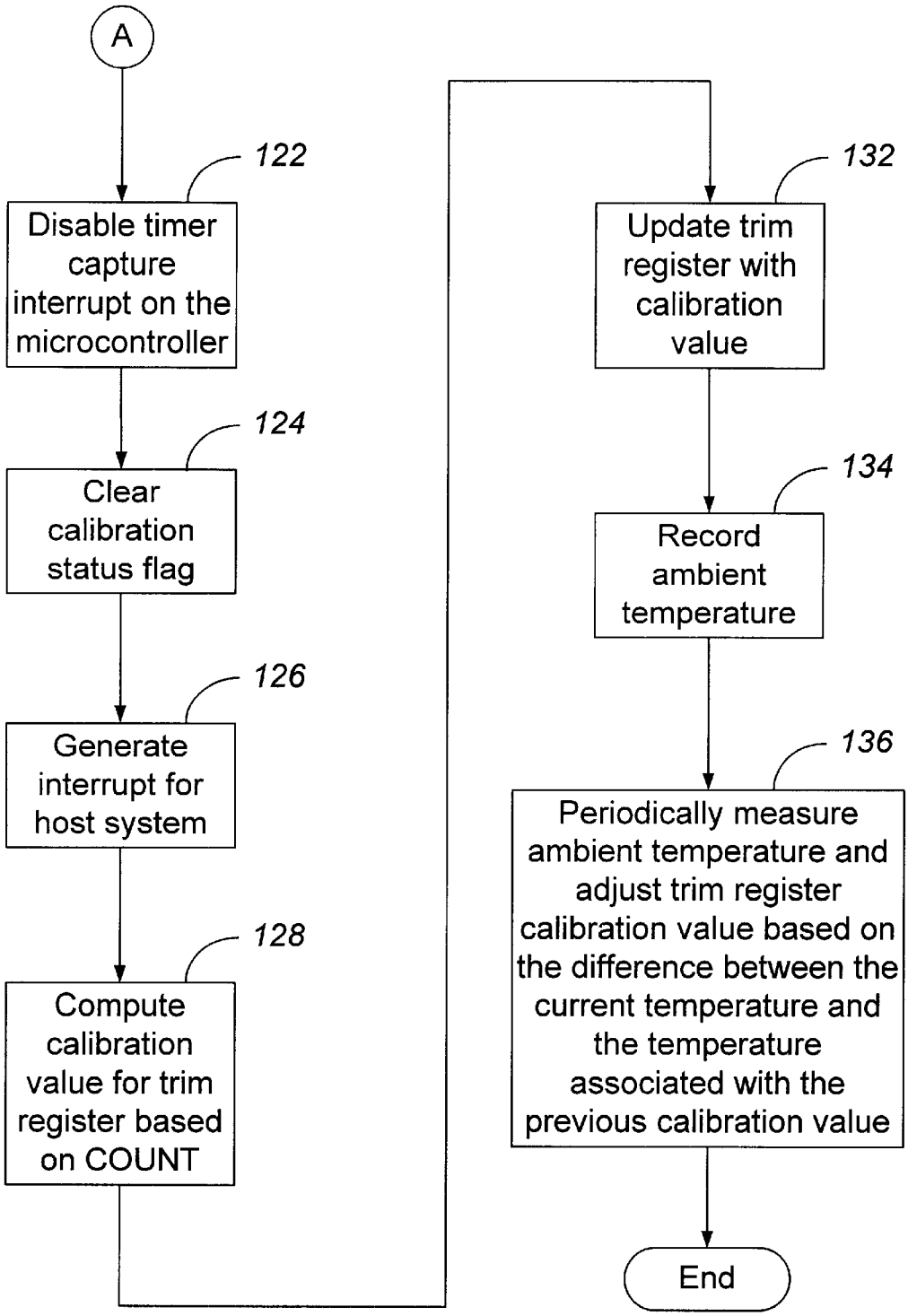

Following connector A to FIG. 5B, operations continue at block 122 where the timer capture interrupt service routine 66 disables the timer capture interrupt on the microcontroller 28 at block 122, clears the calibration status flag at block 124, and generates an interrupt for the host system 42 at block 126 before exiting this second timer capture interrupt. The read calibration count interrupt service routine 88 running on the host system 42 processes the interrupt from the microcontroller 28 and checks the status of the calibration flag to ensure that the calibration results (i.e., COUNT value) is indeed waiting in a predetermined memory location accessible by the host system 42. The read calibration count interrupt service routine 88 then reads the COUNT value from memory and provides this value to the RTC trim program module 84, which determines the calibration value for the trim register 26 at block 128.

In general, the compensation for correcting the inaccuracies of the crystal oscillator may be expressed as follows:

$$compensation\ (\text{ppm}) = \frac{(T_{REF} - T125M) \times 10^6}{T_{REF}} \quad \text{EQ. 1}$$

$$compensation\ (\text{ppm}) = \frac{(.125 - COUNT \times T_{MCLK/4}) \times 10^6}{.125} \quad \text{EQ. 2}$$

$$compensation\ (\text{ppm}) = \frac{(N \times T_{MCLK/4} - COUNT \times T_{MCLK/4}) \times 10^6}{.125} \quad \text{EQ. 3}$$

$$compensation\ (\text{ppm}) = \frac{(N - COUNT) \times T_{MCLK/4} \times 10^6}{.125} \quad \text{EQ. 4}$$

The compensation may also be expressed in terms of a 60 second ideal reference period and the actual period between low-to-high transitions of the 60 second clock generated by bit twenty of the binary up-counter 22:

$$compensation\ (\text{ppm}) = \frac{(60\ \text{s} - (60 \times 32678 \times T_{32\ \text{kHz}})) \times 10^6}{60\ \text{s}} \quad \text{EQ. 5}$$

Note that bit twenty of the binary up-counter 22 has an ideal period of 64 seconds when the base reference signal is exactly 32.768 kHz (i.e., $2^{21}$ cycles/32768 cycles/sec=64 seconds). Accordingly, a nominal four second reload value (200000 (hex)) is loaded into the binary up-counter 22 by the reload register/adder 24 at startup and when the binary up-counter 22 rolls over.

One minute may, therefore, be expressed in terms of the calibration value (RTC_TRIM) for the trim register 26 as follows:

$$60\ \text{sec} = (64 \times 32768 - (4 \times 32768 + RTC_\text{TRIM})) \times T_{32\ kHz} \quad \text{EQ. 6}$$

$$60\ \text{sec} = (60 \times 32768 - RTC_\text{TRIM})) \times T_{32\ kHz} \quad \text{EQ. 7}$$

Substituting Equation 7 into Equation 5 yields:

$$compensation\ (\text{ppm}) = \frac{((60 \times 32768 - \text{RTC_TRIM}) \times T_{32\ \text{kHz}} - 60 \times 32678 \times T_{32\ \text{kHz}}) \times 10^6}{60\ \text{s}} \quad \text{EQ. 8}$$

-continued $$compensation\ (\text{ppm}) = \frac{-\text{RTC_TRIM} \times T_{32\ \text{kHz}} \times 10^6}{60\ \text{s}} \quad \text{EQ. 9}$$

Reversing the dependent and independent variables in Equation 9 yields:

$$\text{RTC_TRIM} = \frac{-compensation \times 10^{-6} \times 60\ \text{s}}{T_{32\ \text{kHz}}} \quad \text{EQ. 10}$$

Substituting the expression for compensation from Equation 4 into Equation 10 yields:

$$\text{RTC_TRIM} = \frac{-(N - COUNT) \times T_{MCLK/4} \times 60\ \text{s}}{.125\ \text{s} \times T_{32\ \text{kHz}}} \quad \text{EQ. 11}$$

Recall that the actual calibration interval period T125M may be expressed as follows:

$$T125M = \text{COUNT} \times T_{MCLK/4} \quad \text{EQ. 12}$$

$$T125M = 4096 \times T_{32\ kHz} \quad \text{EQ. 13}$$

The actual period of the 32.768 kHz crystal oscillator may, therefore, be expressed as follows:

$$T_{32\ \text{kHz}} = \frac{COUNT \times T_{MCLK/4}}{4096} \quad \text{EQ. 14}$$

Substituting the expression for $T_{32\ kHz}$ from Equation 14 into Equation 11 yields:

$$\text{RTC_TRIM} = \frac{(COUNT - N) \times 4096 \times 60\ \text{s}}{.125\ \text{s} \times COUNT} \quad \text{EQ. 15}$$

$$\text{RTC_TRIM} = \frac{1966080 \times (COUNT - N)}{COUNT} \quad \text{EQ. 16}$$

Without loss of accuracy, the following simplification may be made to avoid a more computationally intensive division operation:

$$\text{RTC_TRIM} = \frac{1966080 \times (COUNT - N)}{N} \quad \text{EQ. 17}$$

For TDMA (cellular phones in which the calibration reference signal is 19.44 MHz, $T_{MCLK/4}$=205.76 ns and N=9450C (hex). For CDMA cellular phones in which the calibration reference signal is 19.2 MHz, $T_{MCLK/4}$=208.33 ns and N=927C0 (hex). Using the foregoing values computed for N, the expression for the calibration value for the trim register 26 (RTC_TRIM) may be further simplified as follows:

$$RTC_\text{TRIM} = 3.24 \times (\text{COUNT} - N) \text{ for } f_{MCLK} = 19.44\ \text{MHz} \quad \text{EQ. 18}$$

$$RTC_\text{TRIM} = 3.28 \times (\text{COUNT} - N) \text{ for } f_{MCLK} = 19.2\ \text{MHz} \quad \text{EQ. 19}$$

Equations 18 and 19 provide relatively accurate calibration values (RTC_TRIM) for the trim register 26 using fixed-point multiplication on the host system 42. Nevertheless, if greater accuracy is desired, then the ideal calibration interval period $T_{REF}$ may be lengthened, the timer counter 34/capture register 36 size may be increased, and the calibration reference signal (MCLK) frequency may be increased.

Returning to FIG. 5B the RTC trim program module 84 uses either Equation 18 or Equation 19 to compute the calibration value (RTC_TRIM) for the trim register 26 based on the frequency of the calibration reference signal (MCLK). Note that the calibration value (RTC_TRIM) is an eight-bit signed value that ranges from −128 (0×80) to 127 (0×7f). Bit zero of the binary up-counter 22 is reloaded with a zero in a preferred embodiment of the present invention. Therefore, the calibration value (RTC_TRIM) is divided by two (i.e., right shifted by one bit position) before being written into the trim register 26 at block 132. As illustrated by the reload register/adder 24, if the crystal oscillator is running slow (COUNT>N), then the calibration value will be added to the nominal four second reload value (200000 (hex)) to decrease the number of cycles needed from the crystal oscillator to roll over the binary up-counter 22 every sixty seconds. Conversely, if the crystal oscillator is running fast (COUNT<N), then the calibration value will be subtracted from the nominal four second reload value (200000 (hex)) to increase the number of cycles needed from the crystal oscillator to overflow the binary up-counter 22 every sixty seconds.

At block 134, the temperature compensation program module 86 may optionally measure the ambient temperature using a temperature sensor (not shown) and then record the temperature measurement. The measurement and recordation of the ambient temperature is preferably done contemporaneously with the operations directed to generating the calibration value. Therefore, this temperature measurement is associated with the current calibration value (RTC_TRIM). Next, at block 136, the temperature compensation program module 86 may periodically measure the ambient temperature to determine if the current temperature has deviated from the recorded temperature that is associated with the calibration value (RTC_TRIM). Because the frequency of the crystal oscillator typically varies with temperature, a table may be constructed that associates temperature difference (i. e., the difference between the current ambient temperature and the ambient temperature recorded when the calibration value (RTC_TRIM) was determined) with a frequency compensation value based on the crystal characteristics. This frequency compensation value may then be used to adjust the calibration value (RTC_TRIM) in the trim register 26 based on the current ambient temperature.

Alternatively, it may be desirable to move the temperature compensation functionality into the microcontroller 28. In this case, the ambient temperature associated with the current calibration value (RTC_TRIM) may be measured and recorded before the timer capture interrupt service routine 66 exits at block 126. The sixty second timer interrupt service routine 64 may be modified to measure the ambient temperature once per minute and then to select a frequency compensation value from tie look-up table as discussed in the foregoing. Note that by relieving the host system 42 of the temperature compensation functionality, the host system 42 would not have any role in time-keeping except for the initialization of the calibration value (RTC_TRIM) at power-on and, optionally, on a repeating basis whenever a call is placed to compensate for variations in the crystal frequency that may be caused by age, mechanical shock, or other environmental factors.

The principles of the present invention have been illustrated herein as they are applied to a time-keeping system 20 used in a wireless terminal or cellular phone. From the foregoing, it can readily be seen that the time-keeping system 20 may improve the accuracy of a relatively inexpensive, low power crystal oscillator circuit through use of a more accurate calibration reference signal that need not be available continuously. Moreover, the time-keeping system 20 may be implemented using conventional hardware components (e.g., the 16-bit timer counter 34 with auto-reload on overflow and the 16-bit capture register 36) that may be provided in commercially available microcontroller systems. The time-keeping system 20 is preferably embodied in a wireless terminal. As used herein, the term wireless terminal may include a cellular radiotelephone with a multi-line display, a Personal Communications System (PCS) terminal that may combine a cellular radiotelephone with data processing, facsimile and data communications capabilities, a PDA that can include a radiotelephone, pager, Internet/intranet access, Web browser, organizer, calendar and/or a global positioning system (GPS) receiver, and conventional laptop and/or palmtop receivers that include radiotelephone transceivers. A cellular base station or satellite preferably provides a high accuracy signal, which may be processed to generate the calibration reference signal.

The flowchart of FIGS. 5A–5B shows the architecture, functionality, and operation of an exemplary implementation of the time-keeping system 20 software. In this regard, each block may represent a module, segment, or portion of code, which comprises one or more executable instructions for implementing the specified logical function(s). It should also be noted that in some alternative implementations, the functions noted in the blocks may occur out of the order noted in FIGS. 5A–5B. For example, two blocks shown in succession in FIGS. 5A–5B may be executed substantially concurrently or the blocks may sometimes be executed in the reverse order, depending upon the functionality involved.

In concluding the detailed description, it should be noted that many variations and modifications can be made to the preferred embodiments without substantially departing from the principles of the present invention. All such variations and modifications are intended to be included herein within the scope of the present invention, as set forth in the following claims.

We claim:

1. A method of calibrating an electronic clock having an output signal, comprising the steps of:

providing a calibration reference signal;

providing a base reference signal having an actual frequency and an ideal frequency associated therewith, the electronic clock being responsive to the base reference signal;

setting an ideal number of cycles of the calibration reference signal in an ideal calibration interval, the ideal calibration interval being based on a set number of cycles of the base reference signal at its ideal frequency;

determining an actual number of cycles of the calibration reference signal in an actual calibration interval, the actual calibration interval being based on the set number of cycles of the base reference signal at its actual frequency;

determining a difference between the actual number of cycles of the calibration reference signal and the ideal number of cycles of the calibration reference signal; and adjusting a frequency of the electronic clock output signal based on the difference between the actual number of cycles of the calibration reference signal and the ideal number of cycles of the calibration reference signal.

2. The method of claim 1, wherein the step of determining the actual number of cycles of the calibration reference signal comprises the steps of:

providing a counter that is responsive to the calibration reference signal;

reading the counter at a beginning of the actual calibration interval to obtain a first count;

reading the counter at an end of the actual calibration interval to obtain a second count; and subtracting the first count from the second count.

3. The method of claim 2, wherein the counter implements N least significant bits of a count sequence such that N is a number of which a difference between the second count and the first count is constant.

4. The method of claim 2, wherein the step of subtracting the first count from the second count comprises the step of:

subtracting the first count from the second count with borrow forcing sign extension.

5. The method of claim 1, wherein the electronic clock comprises a counter and wherein the step of adjusting the frequency of the electric clock output signal comprises the steps of:

multiplying the difference between the actual number of cycles of the calibration reference signal and the ideal number of cycles of the calibration reference signal by a scaling factor to generate a calibration value;

storing the calibration value in a trim register that is associated with the electronic clock; and loading the electronic clock counter with a twos-complement sum of the calibration value stored in the trim register and an ideal offset once per period of the electronic clock output signal.

6. The method of claim 5, further comprising the steps of:

recording an ambient temperature contemporaneously with the step of multiplying the difference between the actual number of cycles of the calibration reference signal and the ideal number of cycles of the calibration reference signal by the scaling factor to generate the calibration value;

measuring an ambient temperature after the step of multiplying the difference between the actual number of cycles of the calibration reference signal and the ideal number of cycles of the calibration reference signal by the scaling factor to generate the calibration value; and adjusting the calibration value stored in the trim register based on a difference between the measured ambient temperature and the recorded ambient temperature.

7. A time-keeping system, comprising:

an electronic clock that generates an output signal and a counter capture signal;

a counter that is responsive to a calibration reference signal;

a capture register that stores a value of the counter in response to the counter capture signal;

a trim register;

an adder that adds contents of the trim register with an ideal offset using twos-complement addition and loads a result of the addition in the counter every period of the electronic clock output signal; and a processor that computes a calibration value using successive count values obtained from the capture register, the successive count values being separated in time by a single period of the counter capture signal, the calibration value being stored in the trim register.

8. The system of claim 7, further comprising:

a crystal that generates the base reference signal.

9. The system of claim 7, further comprising:

a frequency scaler component that is responsive to the calibration reference signal and generates a frequency scaled calibration reference signal that is provided as an input to the counter.

10. A computer program product that calibrates an electronic clock having an output signal, comprising:

a computer readable storage medium having computer readable program code embodied therein, the computer readable program code comprising:

computer readable program code that provides a calibration reference signal;

computer readable program code that provides a base reference signal having an actual frequency and an ideal frequency associated therewith, the electronic clock being responsive to the base reference signal;

computer readable program code that sets an ideal number of cycles of the calibration reference signal in an ideal calibration interval, the ideal calibration interval being based on a set number of cycles of the base reference signal at its ideal frequency;

computer readable program code that determines an actual number of cycles of the calibration reference signal in an actual calibration interval, the actual calibration interval being based on the set number of cycles of the base reference signal at its actual frequency;

computer readable program code that determines a difference between the actual number of cycles of the calibration reference signal and the ideal number of cycles of the calibration reference signal; and computer readable program code that adjusts a frequency of the electronic clock output signal based on the difference between the actual number of cycles of the calibration reference signal and the ideal number of cycles of the calibration reference signal.

11. The computer program product of claim 10, wherein the computer readable program code that determines the actual number of cycles of the calibration reference signal comprises:

computer readable program code that provides a counter that is responsive to the calibration reference signal;

computer readable program code that reads the counter at a beginning of the actual calibration interval to obtain a first count;

computer readable program code that reads the counter at an end of the actual calibration interval to obtain a second count; and computer readable program code that subtracts the first count from the second count.

12. The computer program product of claim 11, wherein the counter implements N least significant bits of a count sequence such that N is a number of which a difference between the second count and the first count is constant.

13. The computer program product of claim 11, wherein the computer readable program code that subtracts the first count from the second count comprises:

computer readable program code that subtracts the first count from the second count with borrow forcing sign extension.

14. The computer program product of claim 10, wherein the electronic clock comprises a counter and wherein the computer readable program code that adjusts the frequency of the electronic clock output signal comprises:

computer readable program code that multiplies the difference between the actual number of cycles of the calibration reference signal and the ideal number of cycles of the calibration reference signal by a scaling factor to generate a calibration value;

computer readable program code that stores the calibration value in a trim register that is associated with the electronic clock; and computer readable program code that loads the electronic clock counter with a twos-complement sum of the calibration value stored in the trim register and an ideal offset once per period of the electronic clock output signal.

15. The computer program product of claim 14, further comprising:

computer readable program code that records an ambient temperature contemporaneously with multiplying the difference between the actual number of cycles of the calibration reference signal and the ideal number of cycles of the calibration reference signal by the scaling factor to generate the calibration value;

computer readable program code that measures an ambient temperature after multiplying the difference between the actual number of cycles of the calibration reference signal and the ideal number of cycles of the calibration reference signal by the scaling factor to generate the calibration value; and computer readable program code that adjusts the calibration value stored in the trim register based on a difference between the measured ambient temperature and the recorded ambient temperature.

16. An electronic clock, comprising:

means for providing a calibration reference signal;

means for providing a base reference signal having an actual frequency and an ideal frequency associated therewith, the electronic clock being responsive to the base reference signal;

means for setting an ideal number of cycles of the calibration reference signal in an ideal calibration interval, the ideal calibration interval being based on a set number of cycles of the base reference signal at its ideal frequency;

means for determining an actual number of cycles of the calibration reference signal in an actual calibration interval, the actual calibration interval being based on the set number of cycles of the base reference signal at its actual frequency;

means for determining a difference between the actual number of cycles of the calibration reference signal and the ideal number of cycles of the calibration reference signal; and means for adjusting a frequency of an output signal of the electronic clock based on the difference between the actual number of cycles of the calibration reference signal and the ideal number of cycles of the calibration reference signal.

17. The electronic clock of claim 16, wherein the means for determining the actual number of cycles of the calibration reference signal comprises:

means for providing a counter that is responsive to the calibration reference signal;

means for reading the counter at a beginning of the actual calibration interval to obtain a first count;

means for reading the counter at an end of the actual calibration interval to obtain a second count; and means for subtracting the first count from the second count.

18. The electronic clock of claim 17, wherein the counter implements N least significant bits of a count sequence such that N is a number of which a difference between the second count and the first count is constant.

19. The electronic clock of claim 17, wherein the means for subtracting the first count from the second count comprises:

means for subtracting the first count from the second count with borrow forcing sign extension.

20. The electronic clock of claim 16, wherein the electronic clock comprises a counter and wherein the means for adjusting the frequency of the electronic clock output signal comprises:

means for multiplying the difference between the actual number of cycles of the calibration reference signal and the ideal number of cycles of the calibration reference signal by a scaling factor to generate a calibration value;

means for storing the calibration value in a trim register that is associated with the electronic clock; and means for loading the electronic clock counter with a twos-complement sum of the calibration value stored in the trim register and an ideal offset once per period of the electronic clock output signal.

21. The electronic clock of claim 20, further comprising:

means for recording an ambient temperature contemporaneously with multiplying the difference between the actual number of cycles of the calibration reference signal and the ideal number of cycles of the calibration reference signal by the scaling factor to generate the calibration value;

means for measuring an ambient temperature after multiplying the difference between the actual number of cycles of the calibration reference signal and the ideal number of cycles of the calibration reference signal by the scaling factor to generate the calibration value; and means for adjusting the calibration value stored in the trim register based on a difference between the measured ambient temperature and the recorded ambient temperature.

* * * * *